US005974621A

United States Patent [19]

Wilen

[11] Patent Number: 5,974,621

[45] Date of Patent: Nov. 2, 1999

[54] MOP WRINGER WITH MOP HANDLE SUPPORT

[75] Inventor: Joseph M. Wilen, Atlanta, Ga.

[73] Assignee: Wilen Products, Inc., Atlanta, Ga.

[21] Appl. No.: 09/030,675

[22] Filed: Feb. 25, 1998

Related U.S. Application Data

[60] Provisional application No. 60/063,724, Nov. 3, 1997.

[51] Int. Cl.[6] ..... A47L 13/59

[52] U.S. Cl. ..... 15/261; 15/260

[58] Field of Search ..... 15/260–264

[56] References Cited

U.S. PATENT DOCUMENTS

| | | | |
|---|---|---|---|
| D. 308,741 | 6/1990 | Tsukamoto | D32/51 |
| D. 383,580 | 9/1997 | Bolster et al. | D32/54 |
| 1,882,918 | 10/1932 | Robb | 15/263 |
| 1,952,824 | 3/1934 | Schulman | 15/263 |
| 2,337,319 | 12/1943 | Elkington | 15/261 |
| 2,535,244 | 12/1950 | Voorhis et al. | 15/261 |
| 3,199,136 | 8/1965 | George | 15/231 |
| 3,756,451 | 9/1973 | Popeil | 220/736 |
| 4,165,550 | 8/1979 | Burke | 15/144.2 |
| 4,319,761 | 3/1982 | Wells | 280/47.36 |
| 4,353,142 | 10/1982 | Nishiyama et al. | 15/144.1 |
| 4,407,039 | 10/1983 | Moss | 15/144.2 |
| 4,417,364 | 11/1983 | Hammond | 15/147.1 |
| 4,531,251 | 7/1985 | Pappas et al. | 15/147.1 |
| 4,707,877 | 11/1987 | Griffin | 15/261 |
| 4,722,113 | 2/1988 | Olsson | 15/264 |
| 4,731,897 | 3/1988 | Griffin | 15/147.1 |
| 4,754,518 | 7/1988 | Griffin | 15/262 |
| 4,928,342 | 5/1990 | Friedman et al. | 15/145 |
| 5,133,101 | 7/1992 | Hauser et al. | 15/143.1 |
| 5,333,353 | 8/1994 | Taylor | 15/264 |
| 5,581,839 | 12/1996 | Ferrell, Jr. | 15/143.1 |
| 5,813,567 | 9/1998 | Mangano | 220/735 |

FOREIGN PATENT DOCUMENTS

| | | | |
|---|---|---|---|
| 484207 | 6/1952 | Canada | 15/262 |
| 1434169 | 5/1976 | United Kingdom | 15/262 |
| 2276077 | 9/1994 | United Kingdom . | |

*Primary Examiner*—Mark Spisich

*Attorney, Agent, or Firm*—Womble Carlyle Sandridge & Rice, PLLC

[57] ABSTRACT

A commercial wringer assembly for attachment to a mop bucket is formed with a flange that projects outwardly over the mop bucket and has a contoured forwardly open recess sized to receive and releasibly support or hold the handle of a mop located in the bucket. The recess has forward edges that are contoured to guide the mop handle into the recess and is positioned to support or hold the handle in an upright orientation extending over the mop bucket while the mop is unattended in the bucket.

17 Claims, 4 Drawing Sheets

22
11
28
18
19
19
21
13
23
24
14
27
17
12
17
26
27
16
29

MOP WRINGER WITH MOP HANDLE SUPPORT

CROSS-REFERENCE TO RELATED APPLICATION

This application claims the benefit of U.S. Provisional Application No. 60/063,724, filed Nov. 3, 1997.

TECHNICAL FIELD

This invention relates generally to commercial mop buckets and more specifically to mop wringer assemblies attachable to a mop bucket for ringing excess water from a mop before use, and the wringer assembly further has support means for a mop handle when left unattended.

BACKGROUND OF THE INVENTION

When cleaning commercial buildings such as offices, retail stores, warehouses, and the like, it is common for the floors of such buildings to be wet mopped regularly by janitorial personnel using commercial mops and roll-around mop buckets. Modem commercial mop buckets generally are made of molded plastic that contain water or cleaning solution for wetting the mop and are usually provided with wheels or casters so that the bucket can be moved easily from location to location. In addition, such mop buckets usually are also provided with a wringer assembly for ringing excess water or cleaning solution from the mop after it has been dipped in the bucket and before it is applied to the floor. Wringer assemblies are available in a variety of forms such as, for example, down press wringers and side press wringers, but all function in substantially the same way by compressing the mopping yarns of the mop between opposed surfaces to squeeze excess absorbed liquid from the mop yarns. As liquid is squeezed from the mop yarns, it is expelled from the wringer through perforations or through other openings in the opposed surfaces of the wringer and falls back down into the bucket.

One problem with commercial mop buckets in the past, and indeed with commercial mopping operations in general, occurs when janitorial personnel need to take a break and leave the mop and mop bucket unattended. Since the mopping yarns are usually wet, the mop cannot conveniently be left on the floor and generally must be left in the mop bucket itself. However, since the handles of commercial mops tend to be relatively heavy, they tend to fall over and, in some cases, their weight can flip the entire mop out of the bucket resulting in a mess that must be cleaned. Accordingly, it has been common that, when a mop is to be left unattended, the bucket and mop are rolled to a wall or other structure and the mop handle is leaned against the wall to support it and prevent it from flopping over. Obviously, this is a less than desirable solution, particularly in large open buildings such as warehouses, since the mop and mop bucket must be moved away from the area being mopped and returned when it is desired to continue the mopping operation. This is inconvenient and can add a surprising amount of unproductive time in simple relocation of the mop bucket during a large mopping operation.

Thus, there is a need for a method and apparatus that will eliminate problems caused by mop handles falling over and flipping the mop out of its mop bucket when the mop is unattended. Such a method and apparatus should provide support for the mop handle without an ancillary surface to lean the mop handle against and should accomplish this without requiring that the mop bucket be moved from the area being mopped. It is to the provision of such a method and apparatus that the present invention is primarily directed.

SUMMARY OF THE INVENTION

Briefly described, the present invention, in a preferred embodiment thereof, comprises a method and apparatus for supporting the handle of a commercial mop within the mop bucket while the mop is unattended. The apparatus includes a mop wringer assembly having a pair of hooks for releasably attaching the wringer assembly to a side of a mop bucket to position the wringer assembly inside the bucket. The wringer assembly, which can be a down press wringer, a side press wringer, or any other type of wringer which applies pressure to the yarns of a mop, has a rear wall that is positioned against the interior surface of a wall of a mop bucket when the wringer is installed thereon, a front wall spaced from the rear wall, and side walls. The walls of the wringer assembly, some or all of which may be perforated, define a well for receiving the wet mopping yarns of a mop when it is desired to wring liquid from the yarns. A movable plate, or pair of movable plates in some instances, can be operated by a handle to engage and press against wet mopping yarns to squeeze liquid therefrom. Since the wringer walls, and in many instances the movable plates themselves, are perforated, the liquid squeezed from the mopping yarns passes through the perforations and falls back into the mop bucket.

The wringer assembly of the present invention is provided with a flange on its front wall that projects forwardly from the wall to overly the liquid in the mop bucket. The flange is shaped to define a centrally positioned contoured recess sized and configured to receive the handle of a mop resting in the mop bucket. The recess preferably is located at approximately the center of the mop bucket and has one open side through which the mop handle can be moved to position it in the recess.

In use, the mop bucket and wringer are used in the normal way for wetting a mop, wringing it out, and mopping a floor. However, when it is desired to take a break and leave the mop and bucket unattended, the mop is simply placed in the bucket and its handle is maneuvered into the recess formed in the projecting flange of the wringer. This holds the mop handle securely in an upright position and prevents it from falling or flopping over and possibly flipping the mop entirely out of the bucket. With the present invention, the bucket and mop need not be moved to a location where the mop handle can be propped up against a wall but can simply be left in place at the mopping location and the mopping operation can be continued where it was left off. In this way the lost time and effort often devoted in the past to moving the bucket and propping up the mop handle is saved. A further advantage of this invention is in the storage of mops and mop buckets between uses. In these instances, the bucket can be drained and the mop thoroughly wrung out, whereupon the mop can simply be placed in the bucket with its handle supported in the recess of the wringer flange until the next mopping operation.

Thus, it will be seen that an improved method and apparatus for supporting a mop in its mop bucket is now provided. The invention successfully addresses prior problems in this regard and does so through a device that is efficient, economical to produce, and easy to use. It is thus an object of this invention to provide an apparatus for propping up the handle of a commercial mop while in a mop bucket to prevent the mop from flipping out of the bucket.

It is another object of the invention to provide a method and apparatus for supporting a mop that eliminates the need to move the bucket and mop to a wall or other structure against which the mop handle can be propped.

A further object of the invention is to improve the efficiency of janitorial personnel when mopping floors by saving time and effort often wasted through relocating mops and mop buckets for purposes of propping the mop handle against a structure.

These and other objects, features, and advantages of the invention will become more apparent upon review of the detailed description set forth below taken in conjunction with the accompanying drawing figures, which are briefly described as follows.

DETAILED DESCRIPTION OF THE PREFERRED EMBODIMENTS

Figure 1:
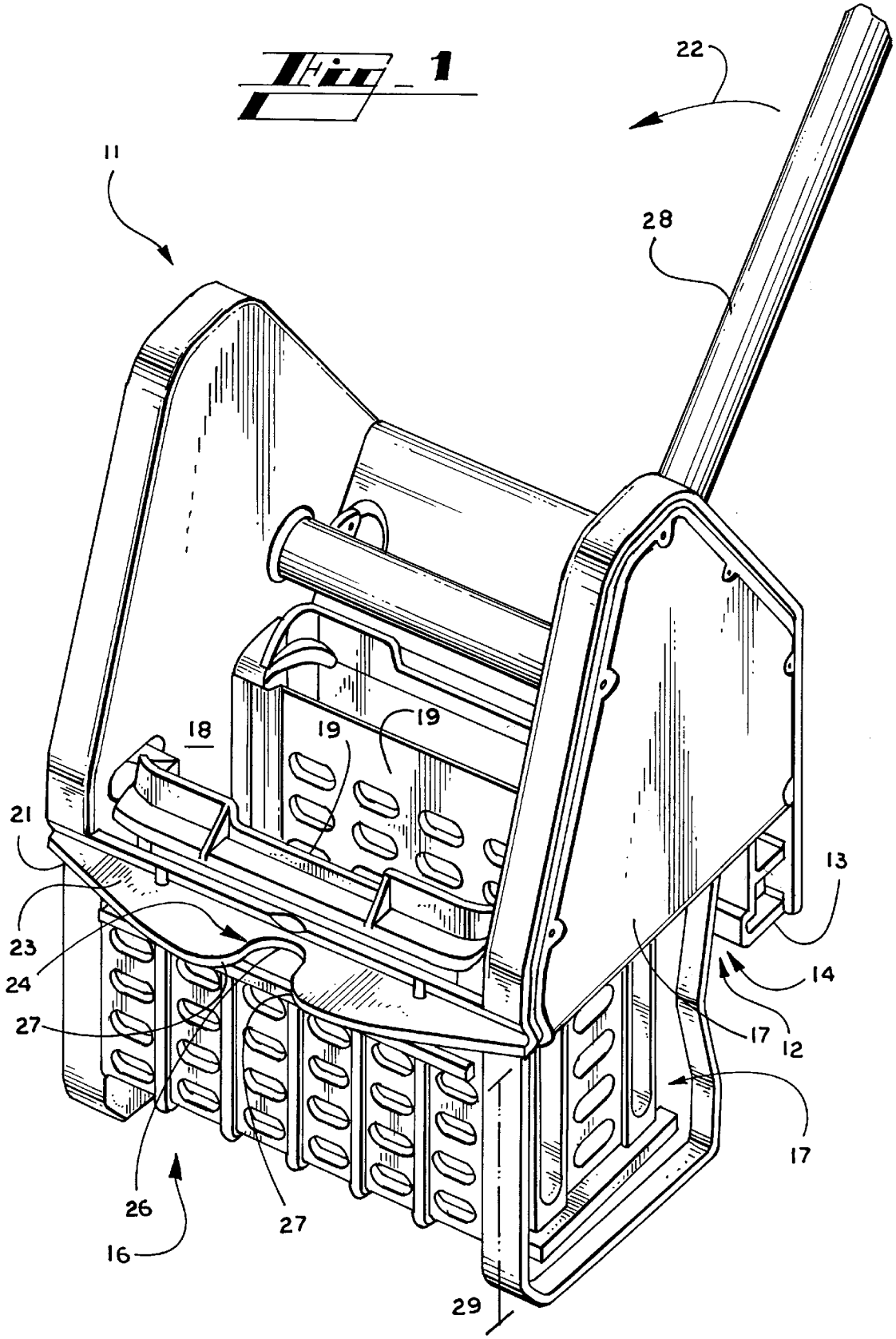
FIG. 1 is a perspective view of a down press wringer assembly with the mop handle supporting means.

Referring now in more detail to the drawings, in which like numerals refer to like parts throughout the several views, FIG. 1 illustrates a down press wringer assembly that embodies principles of the present invention in a preferred form. The wringer assembly 11, which preferably is made of rigid molded plastic, but that can be fabricated from any appropriately rigid material such as metal or acrylic, includes a back wall 12, a front wall 16, a right side wall 17, and a left side wall 18. The walls of the wringer assembly define an upwardly open well 29 sized to receive the mopping yarns of a mop for wringing liquid therefrom.

The wringer assembly 11 is formed with a set of depending hooks 13 adjacent the back wall 12. The hooks 13, which are located at each side of the assembly, define notches 14 sized to be placed over the top edge of a mop bucket (not shown) such that the front 16, back 12, left 18 and right 17 side walls rest within the interior of the mop bucket. The front wall 16 of the wringer assembly and the side walls 17 and 18 are formed with perforations to allow liquid to flow through the walls and back into a bucket on which the wringer assembly is attached when mop yarns are wrung out. A wringer mechanism includes a pair of wringer plates 19 which are disposed within the wringer assembly. The wringer plates 19 are movable toward each other by pressing a handle 28 downwardly in the direction of the arrow 22. In use, the mopping yarns of a wet mop are placed between the plates and the handle 22 is pressed down to squeeze the plates together and wring excess fluid from the mop. This fluid then passes through the perforations in the plates and through the perforations in the walls of the wringer to fall back into the mop bucket.

The means for supporting a mop handle is shown as provided on the front portion 21 of the wringer assembly 11. Although, the means could be located on the side walls of the wringer assembly 11. The front portion of the wringer assembly 11 is formed with a flange 23 that spans the width of the assembly, the flange 23 is projecting outwardly from the wringer assembly 11 and overlying the mop bucket on which the wringer assembly 11 is installed. Flange 23 tapers from a narrow width at the sides of the wringer assembly 11 to a wider width in the central portion of the assembly. The central portion of the flange 23 is formed with a contoured recess 24. The recess 24 is forwardly open, has a rounded back edge 26 and rounded converging side edges 27. While the flange 23 in the preferred embodiment is integrally formed with the molded plastic of the wringer assembly, it could just as easily be made to attach to the wringer assembly with appropriate fasteners as a retrofit component for existing wringers.

In use, the wringer assembly of FIG. 1 is attached to the side of a mop bucket so that the well 29 of the wringer assembly overlies liquid in the bucket. The flange 23 of the assembly projects outwardly and overlies the central portion of the mop bucket. During a mopping operation, the mop bucket and wringer assembly are used in the standard way by submerging the yarns of the mop in a liquid solution within the mop bucket, placing the yarns within the well 29 of the wringer assembly between the plates 19, and pressing the handle 28 down to opposingly engage the plates 19 against the mop yarns to squeeze excess fluid from the mop yarns. The mop can then be used to swab and clean a floor with periodic rinsing and wringing of the mop.

Figure 3:
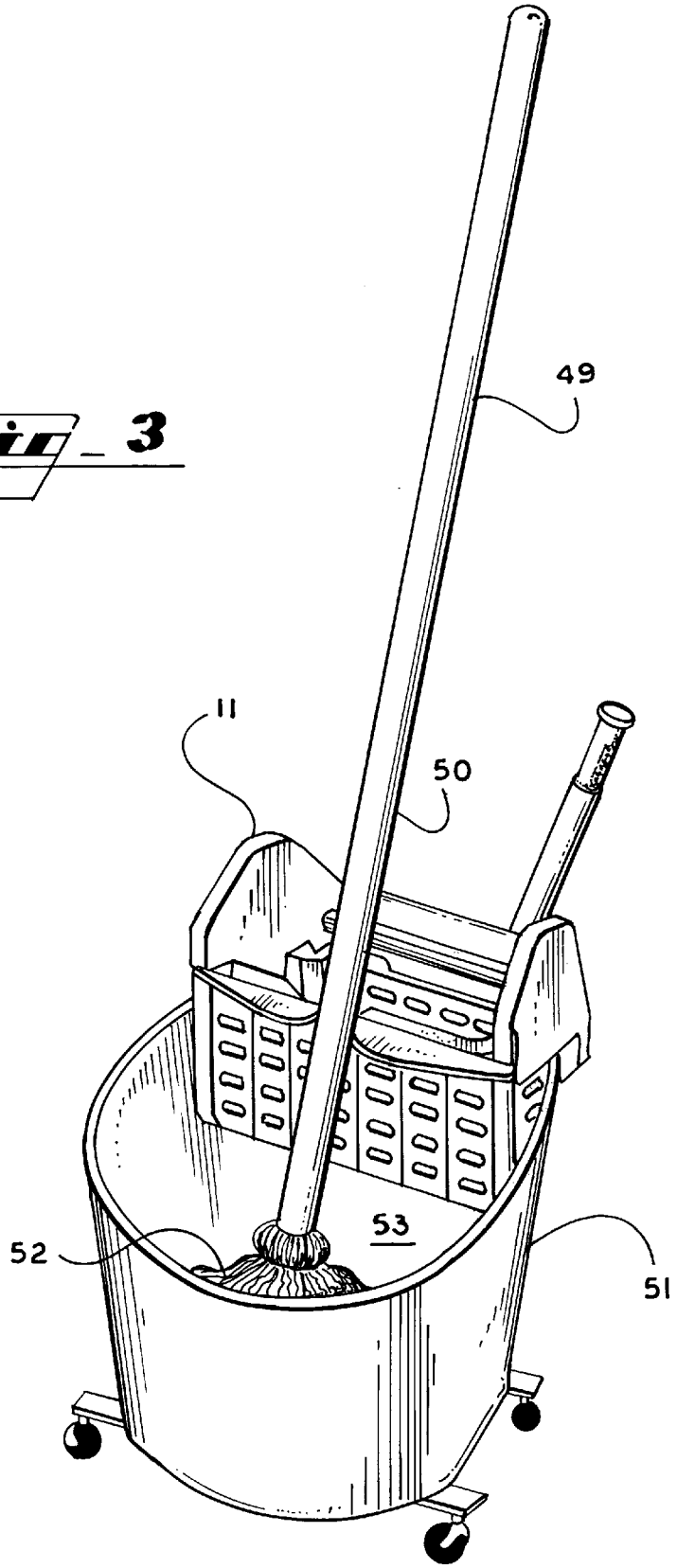
FIG. 3 is a perspective view of a down press wringer assembly attached to a mop bucket with a mop located in the bucket and supported in an upright position by the mop handle supporting means of this invention.

As shown in FIG. 3, when it is desired to take a break or otherwise leave the mop 49 and bucket 51 unattended, a user may practice the method of the instant invention by resting the mopping yarns 52 on the lower end of the mop 49 in the interior 53 of the bucket and maneuvering the handle of the mop into the forwardly open recess 24 of the flange 23. The recess 24 is sized to receive the handle and hold it loosely. In addition, the rounded converging side edges help to direct the mop handle 50 into the recess 24 for ease of use. While rounded forward edges are shown in FIG. 1 for this purpose, it will be understood that straight tapered edges as well as other configurations for directing the mop handle into the recess might be formed into the flange 23.

Figure 4:
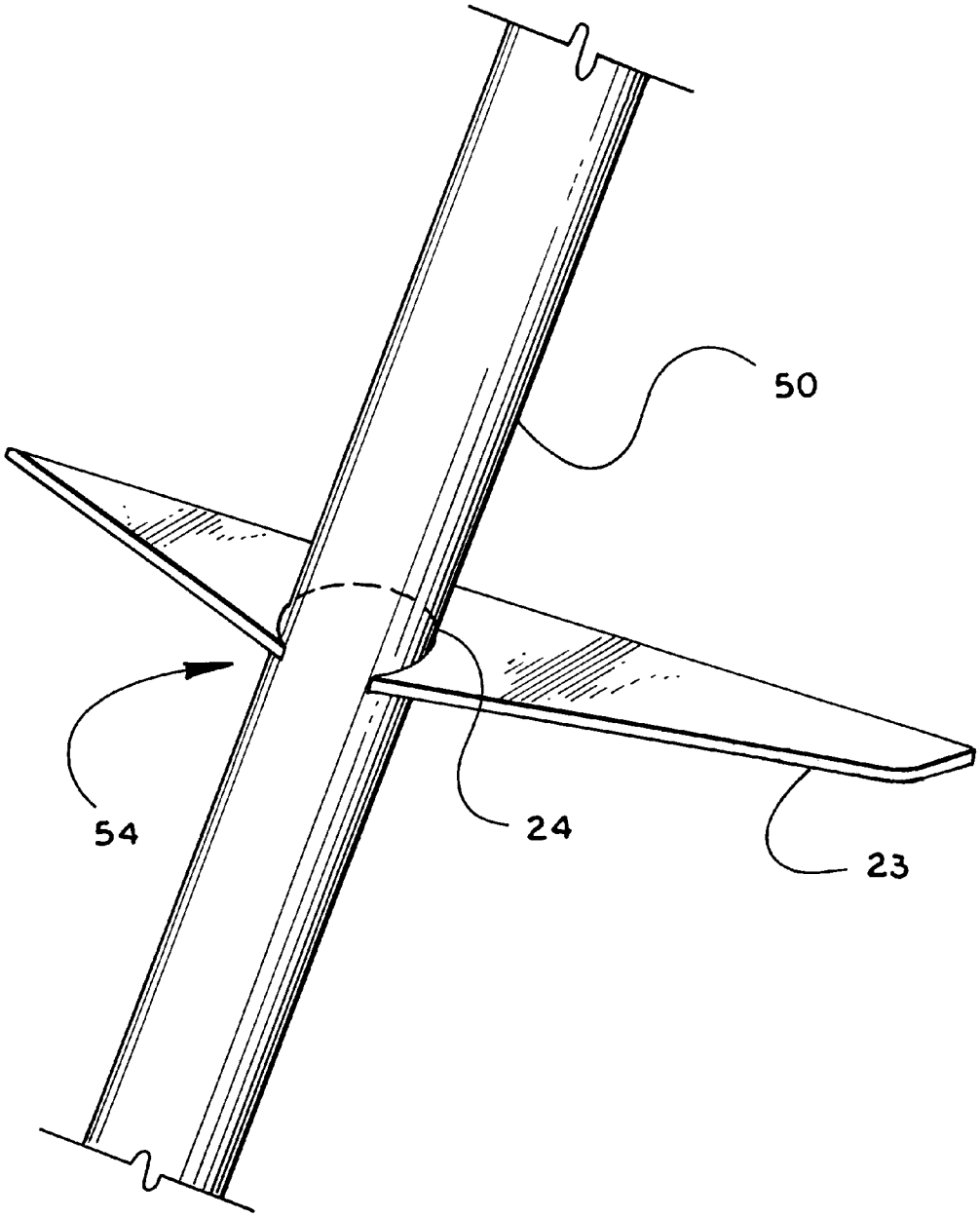
FIG. 4 is a perspective view of a mop handle in a snap-fit relation with the mop handle supporting means of this invention.

Referring to FIG. 3, when the mop handle 50 is positioned within the recess 24, it is supported in an upright position, leaning against walls of the recess 24, and extending over the mop bucket 51 and wringer assembly 11. Thus, the mop handle 50 is prevented from falling over and flipping the mop 49 out of the bucket 51. As an alternative to the loose fit of the mop handle 50 in the recess 24, the recess 24 could engage the mop handle in a frictional securing relation, such as a snap-fit. As shown in FIG. 4, the mop handle 50 can be inserted into a snap-fit 54 within the recess 24. With either configuration, it is no longer necessary with the present invention to move the mop bucket 51 to a wall or other structure for propping up the mop handle 50 while the user is on break or the mop is otherwise unattended. Accordingly, the mop bucket 51 and mop 49 can be left in the mopping area and the mopping operation can be continued at a later time. When it is desired to resume mopping, the user need only continue the mopping operation where it was left off.

Figure 2:
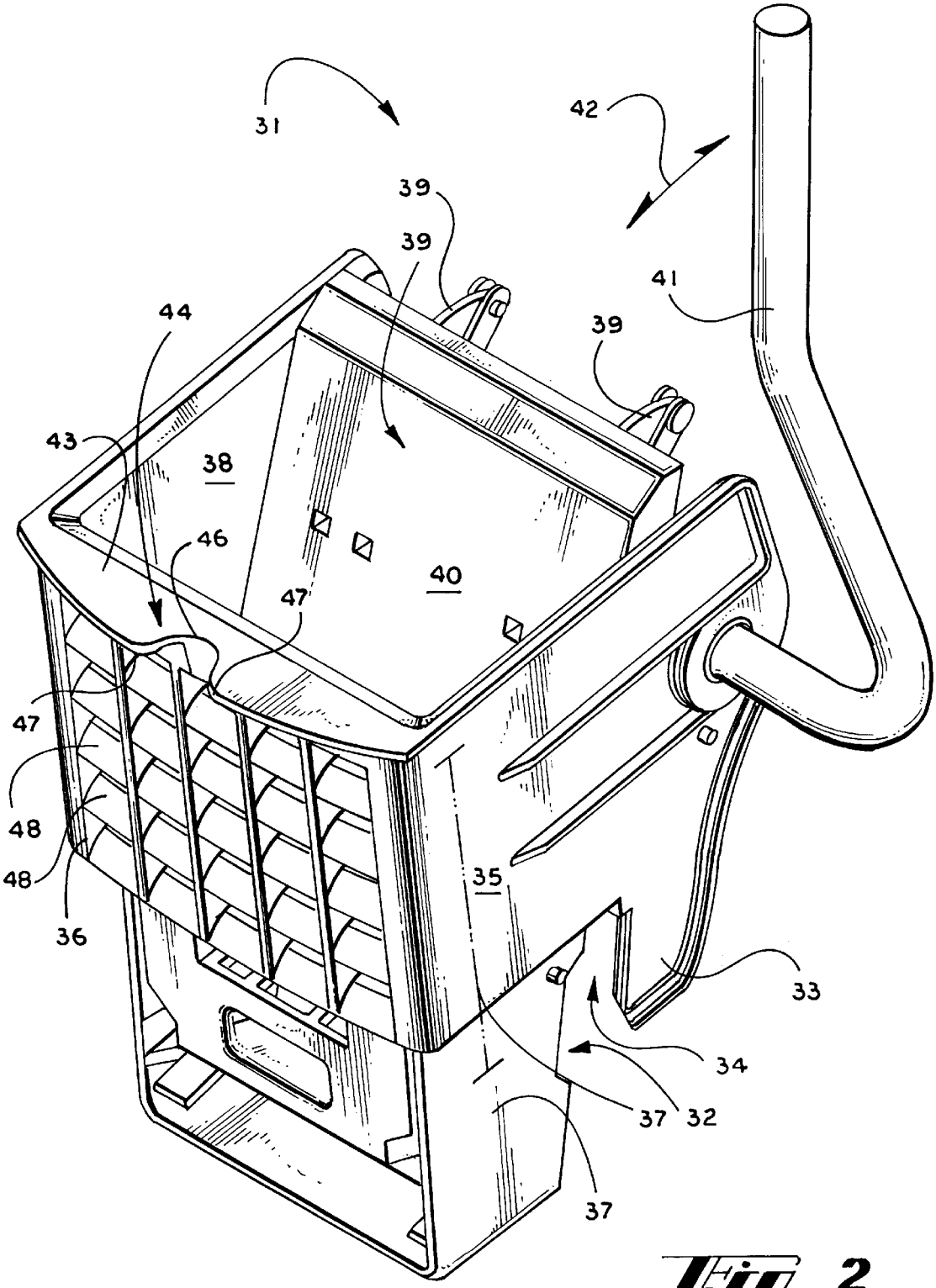
FIG. 2 is a perspective view of a side press wringer assembly with the mop handle supporting means.

FIG. 2 illustrates the present invention embodied in a side press wringer assembly 31. The side press wringer assembly 31 of FIG. 2 represents another type of commercial mop wringer into which the present invention can be incorporated. There are also other types of wringer assemblies, such as roller assemblies, and the present invention should not be construed to be limited to use with a down press wringer assembly (FIG. 1) or a side press wringer assembly (FIG. 2). The assemblies of FIGS. 1 and 2 have been presented only as preferred embodiments and as illustrative of a preferred configuration of the invention.

The side press wringer assembly 31 is formed with a back wall 32, a front wall 36, a right side wall 37, and a left side wall 38. A pair of spaced hooks 33 are formed at the back of the assembly on either side thereof and the hooks 33 define recesses 34 sized to be placed over the top edge of a mop bucket (not shown). The back 32, front 36, and side walls 37 and 38 define an upwardly open well 35 sized to receive the mopping yams of a commercial mop for wringing excess fluid from the mop.

The front wall 36 of the wringer assembly 31 is formed with an array of openings 48 through which liquid can pass. A wringer plate assembly 39 including a wringer plate 40 is positioned in the well 35 of the wringer assembly 31 and is movable toward and away from the front wall 36 by movement of an associated handle 41 in the direction of arrow 42. When the handle 41 is pressed forwardly and downwardly in FIG. 2, the wringer plate 40 moves toward the front wall 36 of the assembly 31. In use, the mopping yarns of a mop are dipped into liquid cleaning agent within the mop bucket, placed in the well 35 of the wringer assembly 31, and excess fluid is squeezed out by pressing down on the handle 41, which compresses the mopping yarns between the wringer plate 40 and the front wall 36.

The means for receiving and supporting the handle of the mop is provided in a forwardly projecting flange 43 formed along the top of the front wall 36 and extending from one side of the assembly 31 to the other. Preferably, the flange 43 is integrally formed with the assembly 31, but can also be provided as an attachable element for retrofitting existing wringer assemblies. The flange 43 is tapered from relatively narrow ends to a relatively wider central portion. The central portion of the flange 43 is formed with a contoured recess 44 sized to receive and hold loosely the handle of a mop located in a mop bucket to which the assembly 31 is attached. The recess 44 has a curved contoured back surface 46 and is forwardly open for receiving the mop handle. Rounded converging side edges 47 help to direct the mop handle into the recess 44.

The side press wringer assembly of FIG. 2 is used in the same general method as illustrated in FIG. 3 to support the handle 50 of a mop when the mop 49 is unattended. Specifically, when janitorial personnel desire to take a break or otherwise leave a mop 49 unattended within its mop bucket 51, the mopping yarns 52 on the lower end of the mop 49 are simply rested in the interior 53 of the mop bucket 51 and the handle 50 of the mop 49 is positioned into the recess 44 formed in the flange 43. The mop handle 50 is thus supported in an upright orientation by the recess 44 until it is desired to continue the mopping operation.

The invention has been described herein in terms of preferred embodiments and methodologies. It will be obvious to those of skill in the art, however, that modifications might be made to the illustrated embodiments within the scope of the invention. For example, the invention has been illustrated in its preferred embodiments as being incorporated into a down press wringer assembly and a side press wringer assembly. Clearly, the invention could also be incorporated into other wringer assemblies or, indeed, in separate dedicated attachments to a mop bucket for supporting the handle of a mop within a bucket. These and other additions, deletions, and modifications might well be made to the illustrated embodiments without departing from the spirit and scope of the invention as set forth in the claims.

What is claimed is:

1. A wringer assembly adapted to be attached to the side of a mop bucket for wringing excess fluid from a mop, said wringer assembly comprising a housing having a front wall and forming an upwardly open well for receiving the mopping yarns of a mop, means for attaching said housing to a mop bucket such that said upwardly open well and said front wall are positioned over the interior of the mop bucket, a wringer mechanism in said well for squeezing the yarns of the mop to wring excess fluid therefrom, and a support on said wringer assembly for receiving and supporting the handle of a mop when the mop handle is positioned against said support, said support comprising a flange projecting from said front wall of said housing to a forward edge located beyond said front wall to define the forward-most extent of said wringer assembly, said flange overlying the interior of a mop bucket when said wringer assembly is attached to the mop bucket and being formed with a recess for receiving the handle of a mop and supporting the handle in an upright orientation over the mop bucket.

2. A wringer assembly as claimed in claim 1 and wherein said housing has a back wall spaced from said front wall and side walls connecting said front and back walls, said recess in said flange being located substantially mid-way between said side walls to support a mop handle in a substantially vertical orientation extending above the mop bucket.

3. A wringer assembly as claimed in claim 2 and wherein said flange is tapered from relatively narrow ends adjacent said side walls to a relatively wider central portion.

4. A wringer assembly as claimed in claim 3 and wherein said recess is formed in said relatively wider central portion of said flange.

5. A wringer assembly as claimed in claim 4 and wherein said recess is forwardly open and has rounded converging side edges for guiding a mop handle into said recess.

6. A wringer assembly as claimed in claim 4 and wherein said recess is configured to receive a mop handle in a snap-fitting relationship.

7. A wringer assembly as claimed in claim 2 and wherein said-flange is integrally molded with said wringer assembly.

8. In a mop bucket and wringer assembly wherein the wringer assembly has front, back, and side walls forming an upwardly open well for receiving the yarns of a mop and a wringer mechanism in the well for squeezing excess liquid from the moping yarns, the front wall and upwardly open well of the wringer assembly being located at least partially within the interior of the mop bucket, the improvement comprising a support projecting forwardly from the front wall and defining the forward-most extent of the wringer assembly, said support overlying the interior of the mop bucket and forming a handle receiving recess disposed substantially at a mid-portion of the front wall of the wringer assembly for receiving and releasably holding the handle of a mop positioned in the mop bucket such that the mop handle is held in an upright orientation over the mop bucket.

9. The improvement of claim 8 and wherein said support comprises a substantially flat flange, said flange being tapered from relatively narrow end portions adjacent said side walls to a relatively wider mid portion centrally located over the mop bucket, said handle receiving recess being formed in said relatively wider mid portion of said flange.

10. The improvement of claim 9 and wherein said recess is forwardly open and is formed with rounded converging side edges for directing a mop handle into said recess.

11. The improvement of claim 8 and wherein said recess is configured to receive a mop handle in releasable snap-fitting relationship to hold the mop handle securely in its upright orientation.

12. The improvement of claim 9 and wherein said flange is integrally molded with said wringer assembly.

13. A mop bucket and wringer assembly comprising a bucket having sides defining an interior well, a wringer assembly removably mounted on one of said sides of said mop bucket and at least partially disposed within said interior well of said bucket, said wringer assembly having a front wall and spaced apart side walls, a flange projecting from said front wall of said wringer assembly to an edge, said flange positioned over said interior well of said bucket and having ends adjacent said side walls of said wringer assembly, and a handle receiving recess formed in said flange intermediate said ends for receiving and releasably holding the handle of a mop disposed in said interior well of said bucket in a substantially upright orientation over said bucket.

14. A mop bucket and wringer assembly as claimed in claim 13 and wherein said flange is tapered from relatively narrow dimensions at said ends to a relatively wider dimension intermediate said ends, said recess being formed at said relatively wider dimension.

15. A mop bucket and wringer assembly as claimed in claim 14 and wherein said recess is formed with converging walls to direct a mop handle into said recess.

16. A mop bucket and wringer assembly as claimed in claim 14 and wherein said recess is shaped to receive a mop handle in a releasable snap-fitting relationship.

17. A mop bucket and wringer assembly as claimed in claim 13 and wherein said flange is integrally molded with said wringer assembly.

* * * * *

US005974621C1

(12) EX PARTE REEXAMINATION CERTIFICATE (9806th)

United States Patent

Wilen

(10) Number: US 5,974,621 C1

(45) Certificate Issued: Aug. 20, 2013

(54) MOP WRINGER WITH MOP HANDLE SUPPORT

(75) Inventor: Joseph M. Wilen, Atlanta, GA (US)

(73) Assignees: Glit/Gemtex, Ltd, Toronto, Ontario (CA); Continental Commercial Products, LLC, Bridgeton, MO (US); Katy Industries, Inc., Bridgeton, MO (US)

Reexamination Request:
No. 90/012,371, Jun. 22, 2012

Reexamination Certificate for:

| | |
|---|---|
| Patent No.: | **5,974,621** |
| Issued: | **Nov. 2, 1999** |
| Appl. No.: | **09/030,675** |
| Filed: | **Feb. 25, 1998** |

Related U.S. Application Data

(60) Provisional application No. 60/063,724, filed on Nov. 3, 1997.

(51) Int. Cl.
*A47L 13/59* (2006.01)

(52) U.S. Cl.
USPC ..... 15/261; 15/260

(58) Field of Classification Search
USPC ..... 15/260, 261
See application file for complete search history.

(56) References Cited

To view the complete listing of prior art documents cited during the proceeding for Reexamination Control Number 90/012,371, please refer to the USPTO's public Patent Application Information Retrieval (PAIR) system under the Display References tab.

*Primary Examiner* — Jimmy G. Foster

(57) ABSTRACT

A commercial wringer assembly for attachment to a mop bucket is formed with a flange that projects outwardly over the mop bucket and has a contoured forwardly open recess sized to receive and releasibly support or hold the handle of a mop located in the bucket. The recess has forward edges that are contoured to guide the mop handle into the recess and is positioned to support or hold the handle in an upright orientation extending over the mop bucket while the mop is unattended in the bucket.

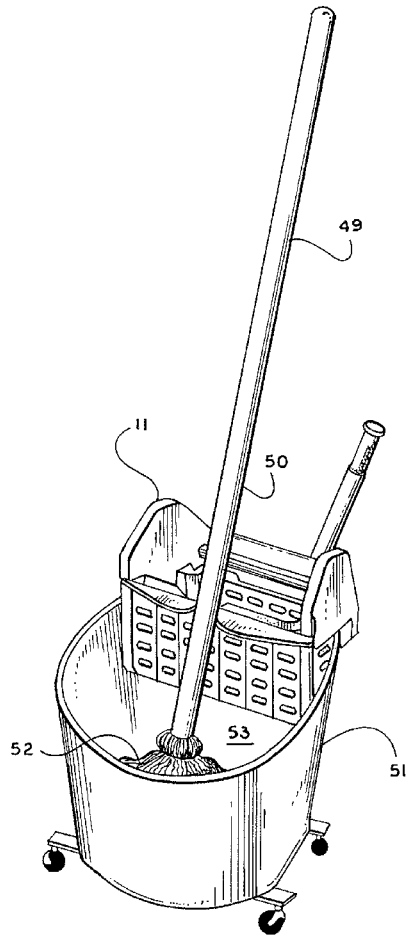

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-17 are cancelled.

* * * * *